US007861374B2

(12) United States Patent
Verdicchio

(10) Patent No.: US 7,861,374 B2
(45) Date of Patent: Jan. 4, 2011

(54) FLEXIBLE HINGE FOR STRUCTURAL PANELS

(75) Inventor: Richard E. Verdicchio, Concord (CA)

(73) Assignee: The Orange Group, Inc., Maple, Ontario (CA)

( * ) Notice: Subject to any disclaimer, the term of this patent is extended or adjusted under 35 U.S.C. 154(b) by 504 days.

(21) Appl. No.: 11/414,474

(22) Filed: Apr. 28, 2006

(65) Prior Publication Data

US 2006/0243691 A1 Nov. 2, 2006

Related U.S. Application Data

(60) Provisional application No. 60/675,912, filed on Apr. 29, 2005.

(51) Int. Cl.
*E05D 1/00* (2006.01)

(52) U.S. Cl. ..... 16/225; 16/271; 16/DIG. 13

(58) Field of Classification Search ..... 16/225, 16/DIG. 13, 385, 271, 272, 387–388
See application file for complete search history.

(56) References Cited

U.S. PATENT DOCUMENTS

| | | | | |
|---|---|---|---|---|
| 317,701 | A * | 5/1885 | Aston | 16/265 |
| 546,909 | A * | 9/1895 | Spencer | 16/270 |
| 651,145 | A * | 6/1900 | Parker | 16/271 |
| 699,970 | A * | 5/1902 | Pickop | 16/271 |
| 3,441,975 | A * | 5/1969 | Shepherd | 16/225 |
| 4,747,441 | A | 5/1988 | Apolzer et al. | |
| 5,133,108 | A | 7/1992 | Esnault | |
| 5,398,376 | A | 3/1995 | Pollack | |
| 5,448,799 | A | 9/1995 | Stein | |
| 5,502,930 | A | 4/1996 | Burkette et al. | |
| 6,098,247 | A | 8/2000 | Santelli | |

FOREIGN PATENT DOCUMENTS

| | | |
|---|---|---|
| EP | 0169697 | 1/1986 |
| EP | 573425 B1 | 12/1993 |
| FR | 2638778 | 5/1990 |
| GB | 2160257 | 12/1985 |

OTHER PUBLICATIONS

International Search Report for PCT/CA2006000687.

* cited by examiner

*Primary Examiner*—William L. Miller
(74) *Attorney, Agent, or Firm*—Thomas, Kayden, Horstemeyer & Risley, LLP

(57) ABSTRACT

A hinge unit useful in the manufacture of readily assembled and erect shelving and storage units and furniture comprises an elongate locking member having a first portion adapted to be received within a slotted channel in the surface of a first panel, a second portion extending away from the elongate member for attaching the hinge to a second panel and integral axial flexion member between the two portions of the hinge. The cross-sectional shape of the elongate locking member and the channel are selected to prevent rotation of the locking member within the channel.

4 Claims, 9 Drawing Sheets

FLEXIBLE HINGE FOR STRUCTURAL PANELS

CROSS-REFERENCE TO RELATED APPLICATION

This application claims priority to U.S. provisional application entitled, "Flexible Hinge For Structural Panels," having Ser. No. 60/675,912, filed Apr. 29, 2005, which is entirely incorporated herein by reference.

FIELD OF INVENTION

This invention relates to a novel hinge system for connecting a pair of panel members so as to allow them to be stacked closely together but readily separated to a selected, fixed perpendicular spacing.

SUMMARY OF THE INVENTION

The hinge system of the invention is useful in the manufacture of easy to assemble and erect structures having two or more vertical or horizontal shelving units, for example, chests, bookshelves, closet organizers, tables and seating. A shelving unit or other structure incorporating the hinge system of the invention can be produced relatively simply and inexpensively by the manufacturer and requires no tools for assembly by the ultimate purchaser and user of the unit.

To achieve these advantages, a hinged panel assembly according to the invention comprises a first panel crossed by an elongate channel having a narrow entranceway; a second panel; a hinge having a first portion located in the channel of the first panel and protruding through the entranceway and a second portion which attaches to the second panel. The first and second portions of the hinge are pivotally connected together by axial flexion means, which can be a conventional hinge pin assembly or a "living" hinge.

The hinge unit connecting the panels itself comprises a dowel or other elongate locking member adapted to be received within a specially routed slotted channel In the surface of a first panel. A leaf member extends away from the elongate member along axial flexion means. The leaf member connects to one surface of a rigid cross piece so as to allow rotational motion of the cross piece in one angular direction, from an extended position perpendicular to the first panel to a folded position substantially parallel to and contiguous with the first panel.

When a second, corresponding hinge unit is installed on the facing surface of a second panel, with the leaf member of that second hinge unit connected to the opposite surface of the cross piece, then translation of the first and second panels in opposite directions results in the folding over of the cross piece and its sandwiching between the first and second panels as they come together.

A particular aspect of the invention is a new and simple method for hingedly connecting a pair of panels. A recess for receiving the dowel portion of the hinge unit is formed In the first panel by routing a narrow rectangular passage into the first panel, then routing a channel into the first panel In open communication with the narrow rectangular passage. The channel receives the dowel portion of the hinge unit, both the channel and the dowel portion having a cross-sectional shape which prevents rotation of the dowel within the channel. Novel router bits are provided for the purpose of forming a channel with narrow entranceway in the first panel or workpiece to receive the first portion of the hinge unit, which may be used with conventional routing tools.

DETAILED DESCRIPTION OF PREFERRED EMBODIMENTS

Figures 1A, 1B:
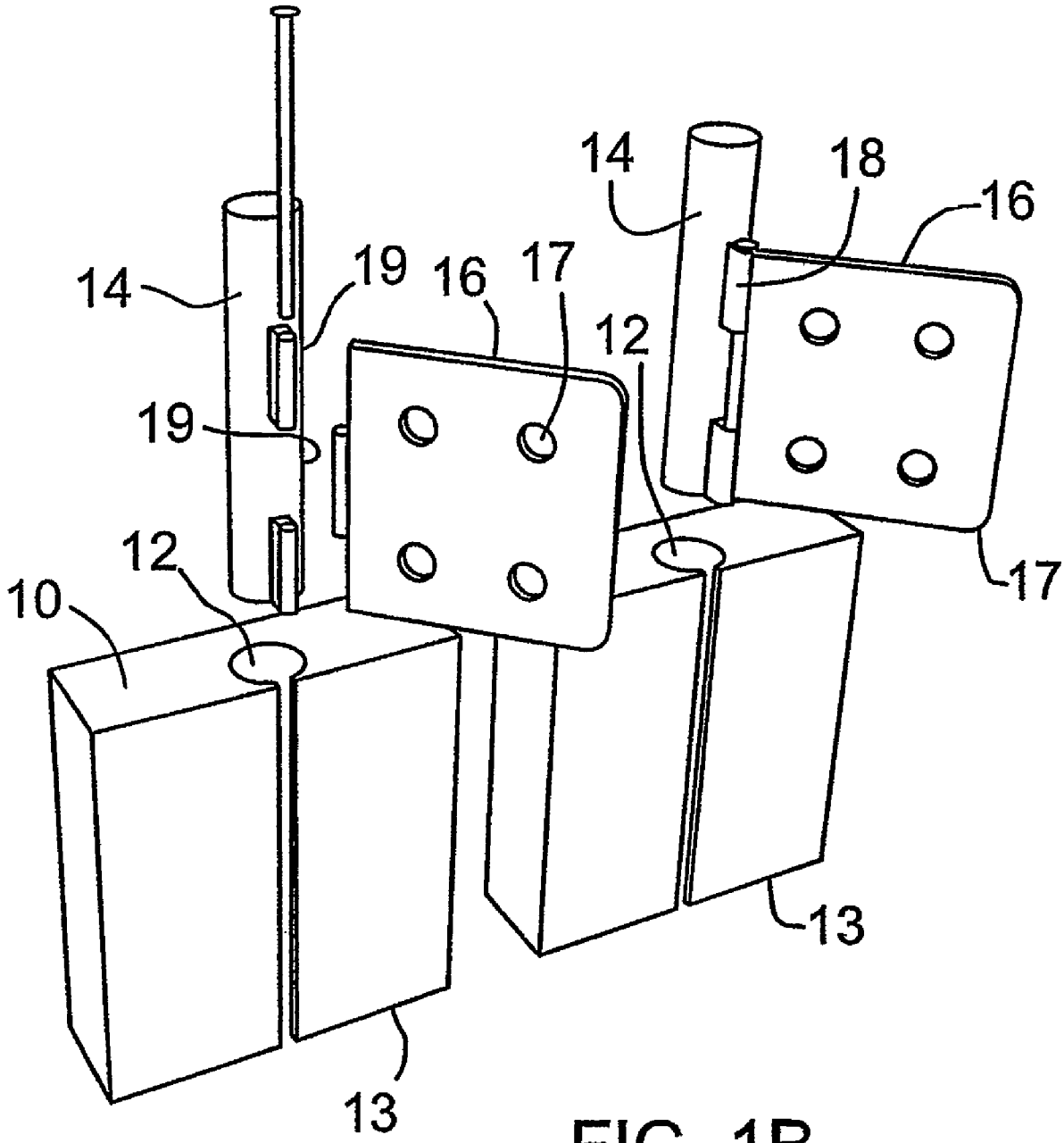
FIGS. 1A and 1B are respectively disassembled and assembled schematic views of the hinge system of the invention according to a first embodiment ("pin edge").

In the drawings, 10 indicates a portion of a panel member, such as a shelf, which has been prepared for installation of a hinge unit according to the invention by routing therealong a channel 12 open to the surface along slot 13. An elongate locking member 14 of the hinge unit is configured to slide into channel 12 leaving axial flexion means projecting outwardly through slot 13 and connecting. In the drawings, for different embodiments of the hinge system, analogous components will be identified by the same numerals, but differing alphabetic subscripts.

In the embodiment of hinge unit illustrated in FIGS. 1A to 2C (the "pin edge" arrangement) elongate locking member 14 is in the form of a circular dowel but, as will be noted below, other cross sections are possible and useful for particular applications.

Hinge leaf 16 is pivotably connected to member 14 by axial flexion means 18 which, in the embodiment illustrated, comprise aligned interfitting hinge eyes 19 for removably receiving a hinge pin 20 which holds the leaf 16 to the locking member 14, and allows the leaf to swing smoothly and freely relative to the facing surface of panel member 10. Leaf 16 may be provided with apertures 17 through which screws or other fastening means can be inserted to Interconnect a pair of panel members. The locking member 14, hinge pin 20, hinge eyes 19 and the leaf 16 may be made of any machinable metal or alloy such as brass or steel.

Figure 2C:
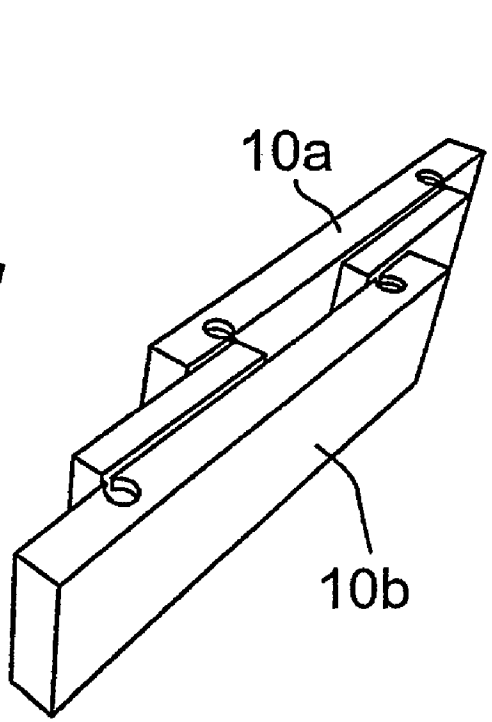
FIGS. 2A to 2C illustrate the erection or folding up of a two-shelf unit employing four of the hinge systems of FIG. 1.
Figure 2B:
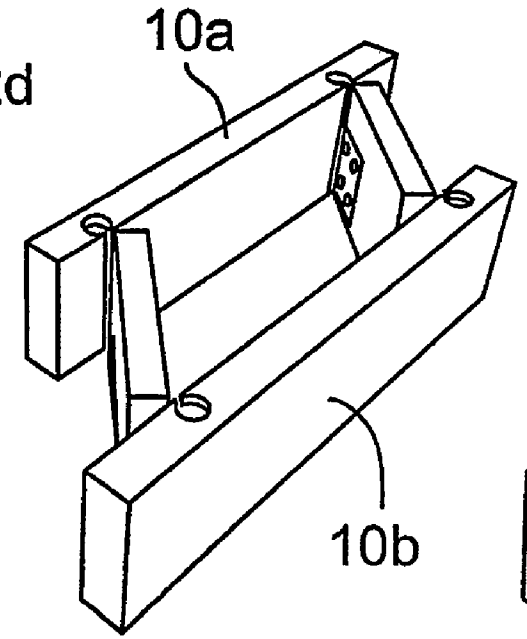
Figure 2A:
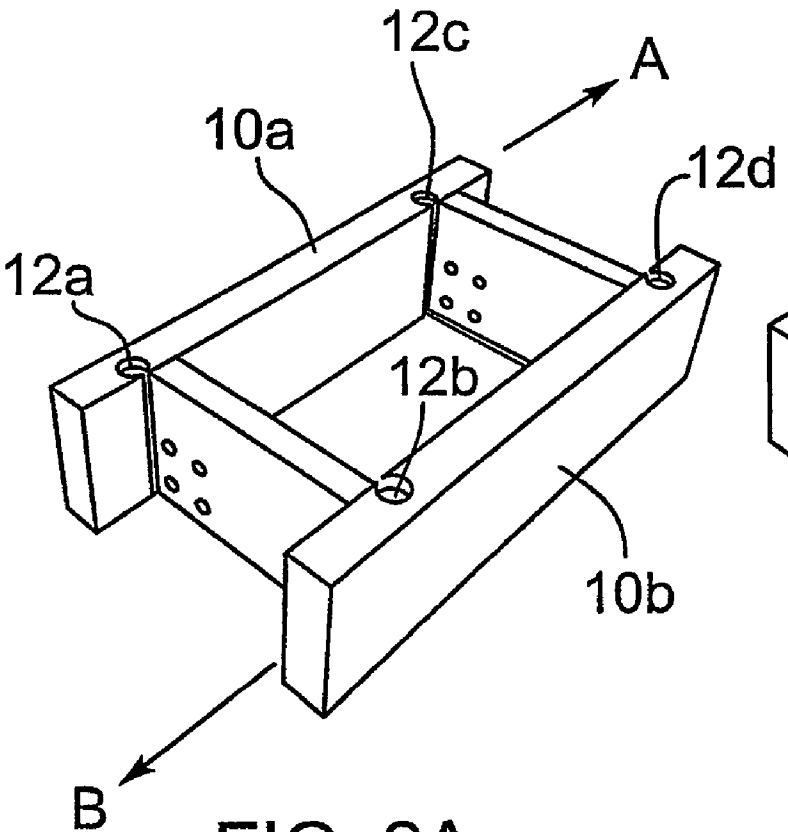

A two-panel hinged interconnection according to the invention is Illustrated in FIGS. 2A to 2C. Parallel panel members 10*a* and 10*b* are provided with opposed pairs of routed channels (12*a*, 12*b*) and (12*c*, 12*d*). Hinge units as described In connection with FIGS. 1A and 1B are fitted into the routed channels in the facing panel members. Extending between opposed pairs of hinge units are cross pieces 22*a* and 22*b*, to which the leaves 16*a* and 16*b* of opposed hinges are attached to opposite surfaces of the cross piece. Translation of parallel panels 10*a* and 10*b* in the opposite directions indicated by arrows A and B then collapses the four-member structure (two panels/shelves and two cross pieces) into the flat, stackable arrangement of FIG. 2C.

The pin edge arrangement, employing metallic hinge components, is intended for heavy duty use. For smaller shelf-or storage space installations, a light plastic living hinge structure is useful. A hinge unit of that kind is illustrated in FIG. 3.

Figure 3:
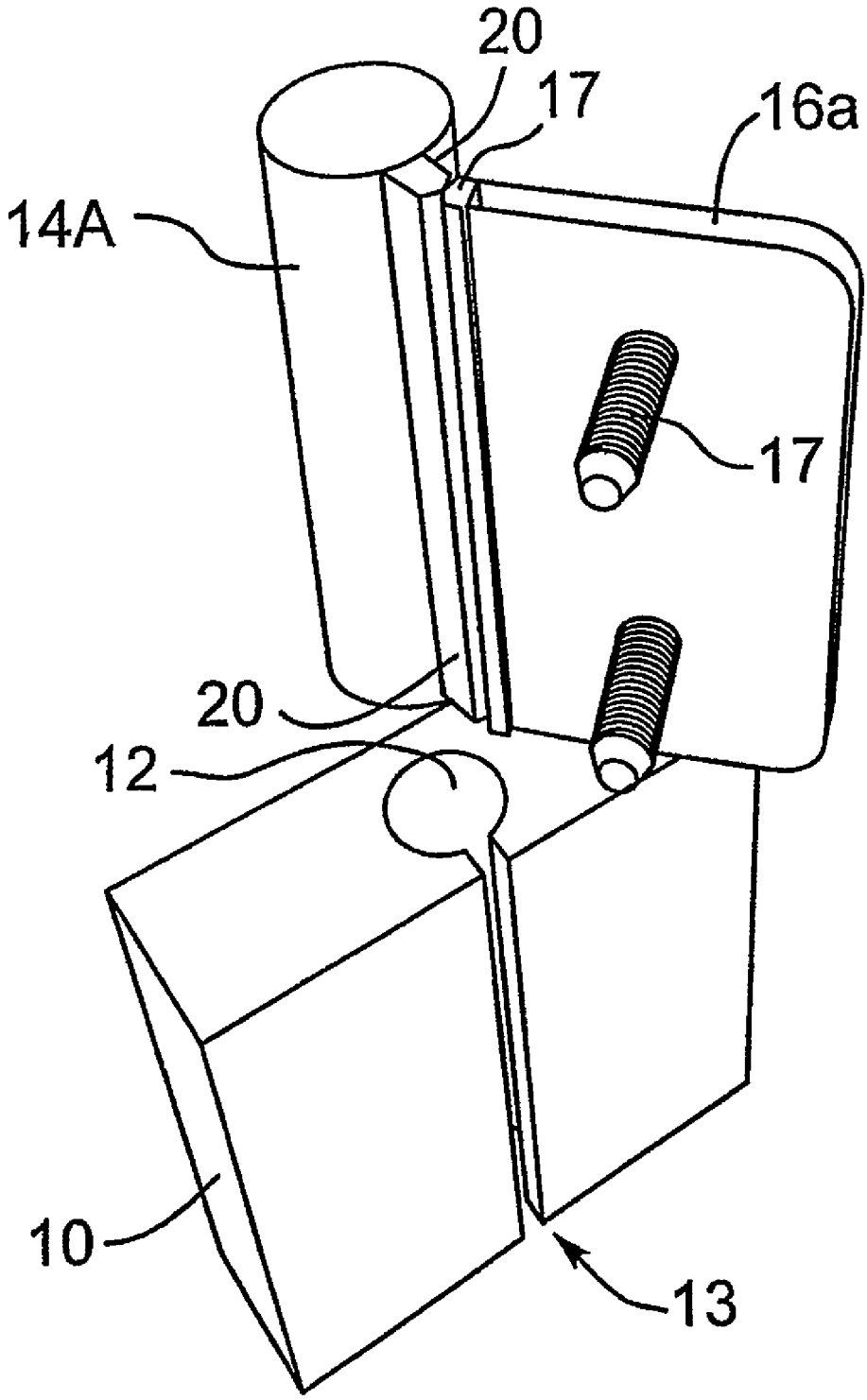
FIG. 3 is a schematic view of a second embodiment ("flex hinge") of hinge system according to the present invention.

The embodiment of hinge unit illustrated in FIG. 3 is an integral hinge formed of an engineering plastic, in which flexion is afforded by a thinned portion or notch line 17 in the plastic material connecting leaf 16*a* to a narrow ledge extension 20 extending diametrically away from the locking member portion 14*a* and through the slot portion 13 of routed channel 12 in a panel member 10.

Suitable materials for manufacturing this "flex hinge" version of the hinge unit of the invention include engineering grades of polyvinyl chloride (PVC) copolymers of polystyrene [e.g. ABS], polyethylene, polypropylene and polyamides (nylon). With suitable materials, the entire hinge unit can be made in a single injection molding step.

The flex hinge of FIG. 3 can be used to form a collapsing shelf structure as In FIGS. 2A to 2C, just as with the pin edge metallic hinge unit of FIG. 1. For added locking stability, the flex hinge can be made with locking dowels 24 integral with and perpendicular to leaf 16*a*, for fitting into corresponding holes formed in the cross pieces of the structure (not shown in FIG. 3).

Figure 4A:
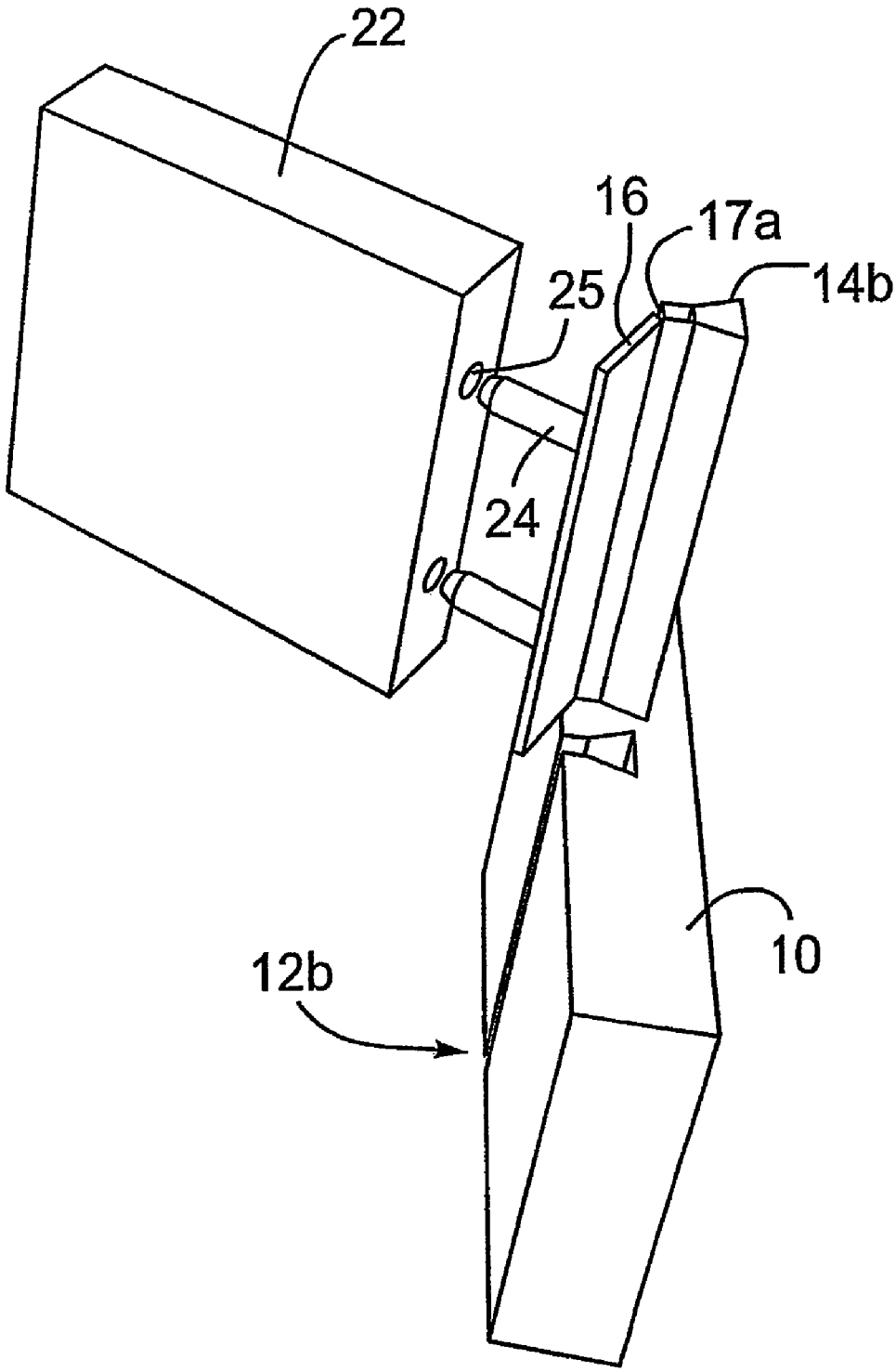
FIG. 4A is a schematic view of a further example of a hinge system according to the second embodiment of the invention.
Figure 4B:
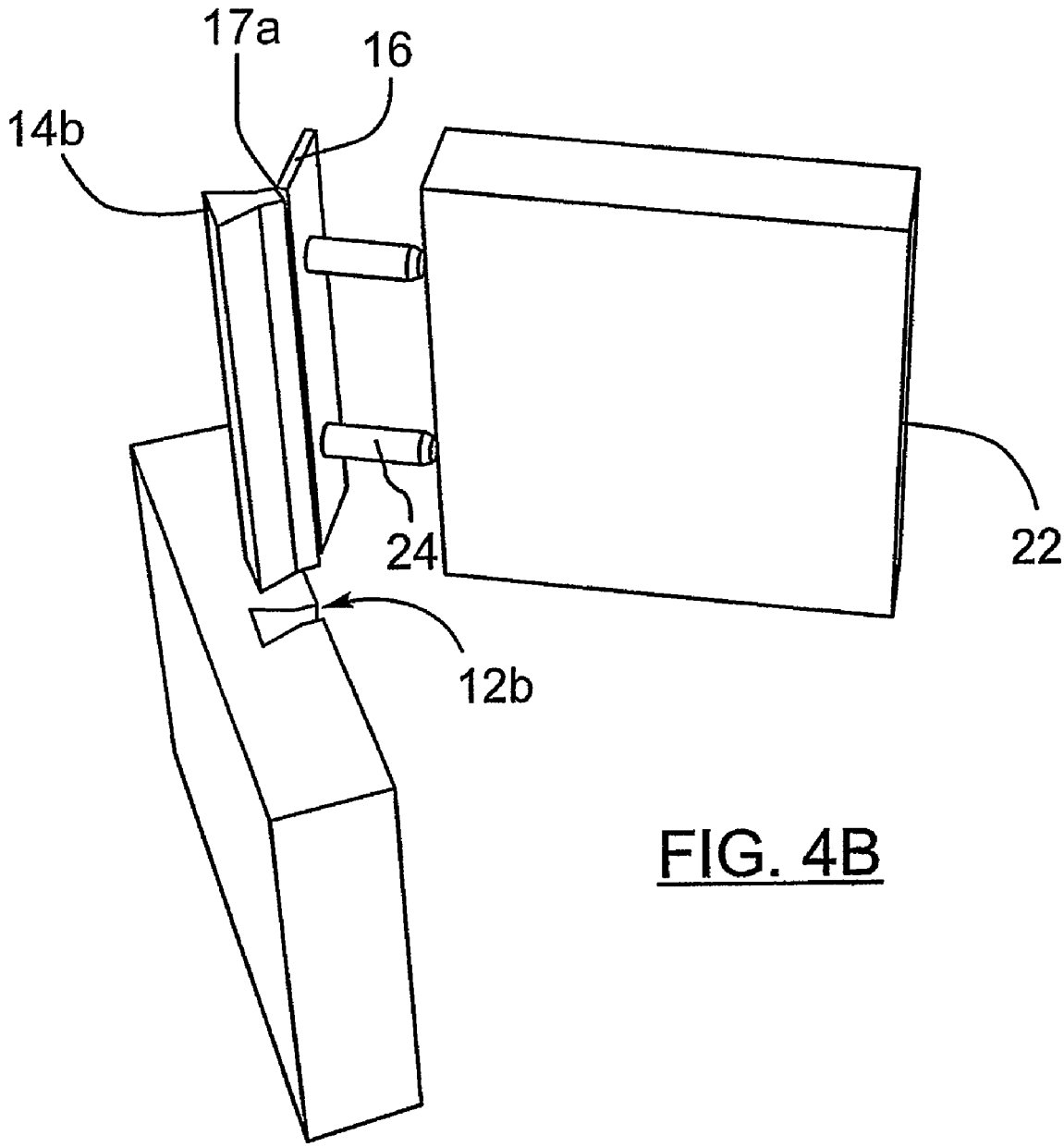
FIG. 4B is a different perspective view of the hinge system of FIG. 4A.

FIGS. 4A and 4B show a flex hinge unit like that of FIG. 3, but with the elongate locking member indicated by 14*b* having a different, part-triangular cross-sectional shape. A mating slotted channel 12*b* is shown routed into the surface of a panel 10 to be hingedly joined to cross piece 22. Flexion at the hinge is about notch line 17*a*.

Again, leaf portion 16*a* is provided with locking dowels 24 which fit within mating recesses 25 in cross piece 22.

Figure 5:
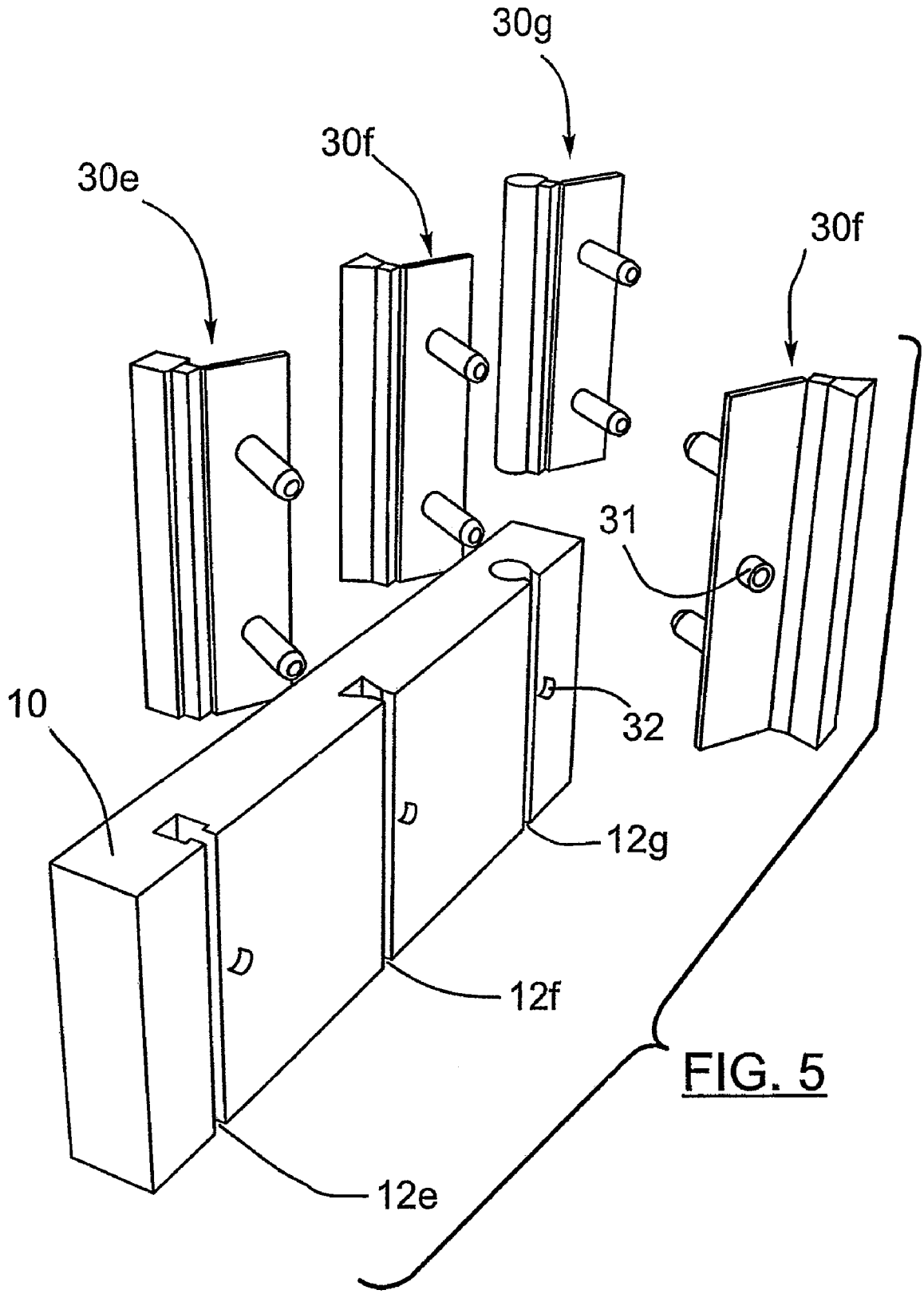
FIG. 5 illustrates a panel adapted to receive three hinge units according to the invention having elongate locking members of differing cross-sectional contour.

FIG. 5 shows a panel member 10 in which three different routed channel configurations 12*e*, 12*f* and 12*g* have been formed, respectively square, triangular and circular and adapted to connect with hinge units 30*e*, 30*f* and 30*g*.

A second, reverse-side view is given of hinge unit 30*f* to show the provision on these units of integral projections 31 which, In fully assembled configurations of the storage unit, fit into and engage corresponding recesses 32 on the panel (shelf) members for added stability of the erected structure.

Figures 6A, 6B:
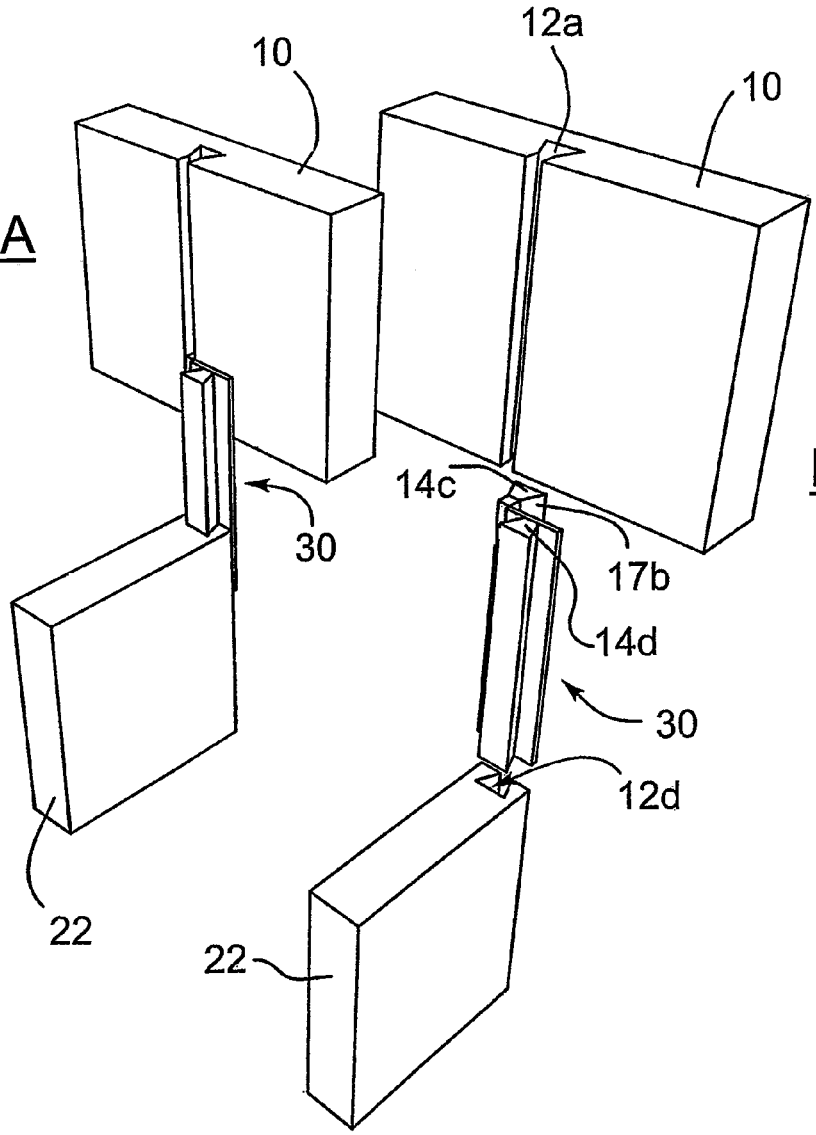
FIGS. 6A and 6B are schematic views of a third embodiment of hinge system according to the present invention, respectively showing the hinge partly and completely removed from the locking channel.
Figures 6C, 6D:
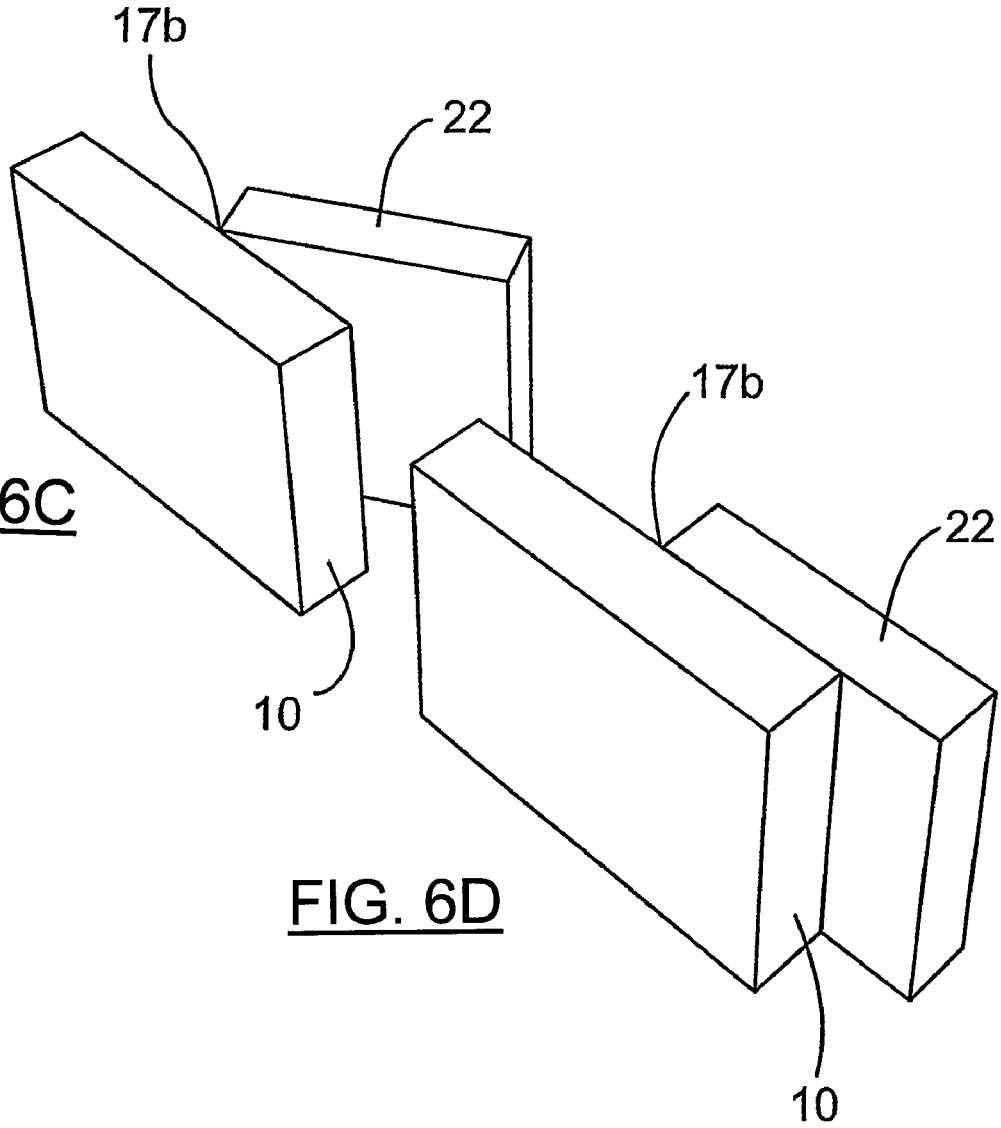
FIGS. 6C and 6D are two views of the hinge system of FIGS. 6A and 6B, fully assembled, with the panel and cross piece shown at two different angular spacings.

Particular ease of manufacture of hinges according to the present invention is illustrated by the "dovetail" version of hinge unit indicated by 30 in FIGS. 6A and 6B. The hinge 30 may be made in indefinite lengths by extrusion molding and cutting to fully formed hinges of the desired length. The hinge contour comprises two elongate locking members 14*c* and 14*d* at opposite sides of axial flexion means. These locking members respectively engage with corresponding routed channels 12*c* which has been formed in the main panel member 10 and the cross pieces 22, respectively. The fully connected panel member 10 and row piece 22 are illustrated in FIG. 6B, at two different angular spacings.

Figure 7:
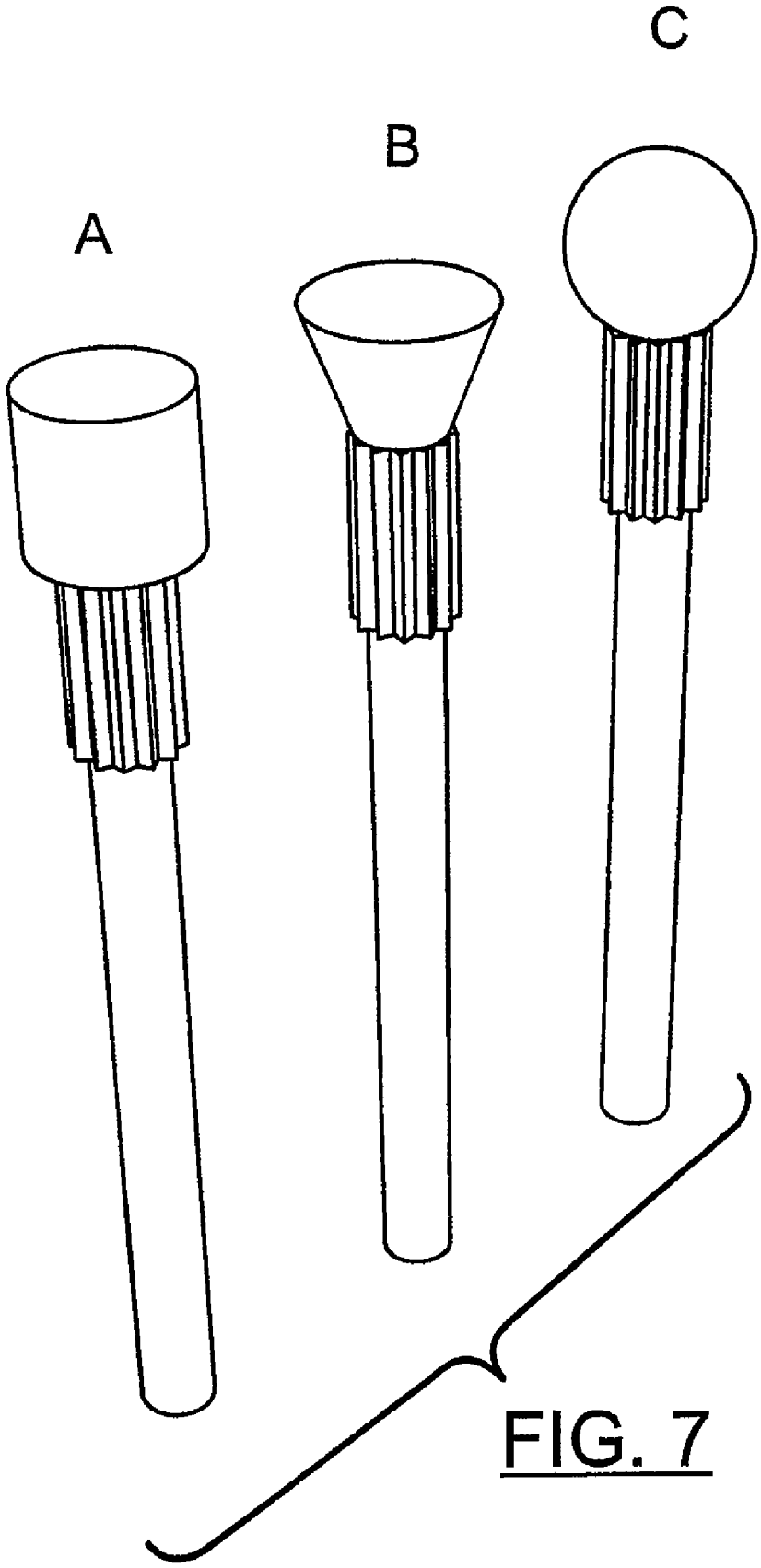
FIGS. 7A, 7B and 7C are perspective views of three examples of router bits for use in forming channels in panel members to receive hinge units according to the invention.

FIG. 7 illustrates three forms of router bit which have been developed to form slotted channels of different configurations. Thus, routers of shapes A, B and C have the configurations 12*b* in FIG. 4 and 12*a* in FIG. 3, respectively.

While specific embodiments of the invention have been described, it will be appreciated by those skilled in the art that various modifications and alternatives could be developed in light of the overall teachings of the disclosure. Accordingly, the particular arrangements disclosed are meant to be Illustrative only and not limiting as to the scope of the invention which is to be given the full benefit of all the claims appended and any and all equivalents.

The invention claimed is:

1. A hinged panel assembly, comprising:

a first panel having an elongate channel with a narrow entranceway having a width less than a maximum width of said channel;

a second panel;

a hinge with a first portion located in said channel and protruding through the entranceway of the channel and a second portion attached to the second panel, said first and second portions of the hinge being pivotably connected together by axial flexion means; and means for releasably locking said first panel and said second panel together for added stability of the assembly;

wherein said means for releasably locking together comprise said second portion of the hinge being attached to said second panel by means of corresponding locking dowels and apertures respectively on said second portion of the hinge and on said second panel.

2. A hinged panel assembly according to claim 1, wherein said hinge is fabricated of an engineering plastic material and said flexion means comprises a thinned notched line in the plastic material between the first and second portions thereof.

3. A hinged panel assembly, comprising:

a first panel having an elongate channel with a narrow entranceway having a width less than a maximum width of said channel;

a second panel;

a hinge with a first portion located in said channel and a radial extension protruding through said entranceway of the channel, a second portion attached to the second panel and axial flexion means connecting said first and second portions of the hinge means for releasably locking said first panel and said second panel together for added stability; wherein said means for releasably locking together comprise a projection on said second portion of the hinge and a corresponding recess on said first panel, wherein said projection extends substantially perpendicular to said second portion of the hinge.

4. A hinged panel assembly according to claim 3, wherein said hinge is fabricated of an engineering plastic material and said flexion means comprises a thinned notched line in the plastic material between the first and second portions thereof.

* * * * *